US011794867B1

(12) United States Patent
Li et al.

(10) Patent No.: US 11,794,867 B1
(45) Date of Patent: Oct. 24, 2023

(54) DRIVING METHOD OF LIFTING DEVICE OF UNDERWATER SURVEY SYSTEM

(71) Applicant: Tianjin University, Tianjin (CN)

(72) Inventors: Xingfei Li, Tianjin (CN); Yehao Liu, Tianjin (CN); Jiayi Xu, Tianjin (CN); Haiqiao Wei, Tianjin (CN); Shiduo Wang, Tianjin (CN)

(73) Assignee: TIANJIN UNIVERSITY, Tianjin (CN)

( * ) Notice: Subject to any disclaimer, the term of this patent is extended or adjusted under 35 U.S.C. 154(b) by 0 days.

(21) Appl. No.: 18/310,308

(22) Filed: May 1, 2023

(30) Foreign Application Priority Data

May 12, 2022 (CN) ..... 202210511932.7

(51) Int. Cl.
*B63G 8/24* (2006.01)
*B63G 8/00* (2006.01)
*B63C 11/52* (2006.01)

(52) U.S. Cl.
CPC ..... *B63G 8/24* (2013.01); *B63C 11/52* (2013.01); *B63G 8/001* (2013.01)

(58) Field of Classification Search
CPC .. B63G 8/00; B63G 8/001; B63G 8/24; B63C 11/00; B63C 11/52
USPC ..... 114/331
See application file for complete search history.

(56) References Cited

FOREIGN PATENT DOCUMENTS

CN 110979609 A 4/2020
CN 213928937 U * 8/2021

OTHER PUBLICATIONS

Chen Danfeng, A hybrid buoyancy engine for deep-sea mobile float: design and application research,Basic Science Series of Full Text Database of Chinese Excellent Master's Thesis,Issue 06, 2020, pp. 21-22, Jun. 15, 2020.
CNIPA, Notification of a First Office Action for CN202210511932.7, dated Jun. 17, 2022.
Tianjin University (Applicant), Reply to Notification of a First Office Action for CN202210511932.7, w/ (allowed) replacement claims, dated Jun. 28, 2022.
CNIPA, Notification to grant patent right for invention in CN202210511932.7, dated Jul. 1, 2022.

* cited by examiner

*Primary Examiner* — Lars A Olson
(74) *Attorney, Agent, or Firm* — Zhigang Ma

(57) ABSTRACT

A driving method is implemented to a lifting device of an underwater survey system, and the lifting device includes a phase-change heat exchange module, an oil bag module, a pressurized energy storage module, and a drive energy storage module. The driving method includes: controlling the pressurized energy storage module to extract hydraulic oil in the oil bag module to descend the lifting device; during a transformation of a phase-change material, the pressurized energy storage module transmitting hydraulic oil to the phase-change heat exchange module; transmitting the hydraulic oil inside the oil bag module to the pressurized energy storage module to descend the lifting device; controlling the drive energy storage module to transmit hydraulic oil to the oil bag module for rising the lifting device; and during a transformation of the phase-change material, transmitting the hydraulic oil in the phase-change heat exchange module to the drive energy storage module.

9 Claims, 8 Drawing Sheets

DRIVING METHOD OF LIFTING DEVICE OF UNDERWATER SURVEY SYSTEM

TECHNICAL FIELD

The disclosure relates to the driving field of lifting devices, and particularly to a temperature difference energy driving method of a lifting device with two energy storage structures of an underwater survey system.

BACKGROUND

Temperature difference energy buoyancy adjustment methods have been widely used for driving lifting devices for underwater survey systems. However, the existing temperature difference energy buoyancy adjustment methods have shortcomings in solidification of phase-change materials, such as insufficient solidification power and low utilization of volume changes of the phase-change materials, and the existing temperature difference energy buoyancy adjustment methods are difficult to conduct long-term continuous surveys because of low conversion efficiency of the temperature difference energy. In order to improve the effect of underwater surveys, it is urgent to improve a driving method of a lifting device of an underwater survey system.

SUMMARY

Embodiments of the disclosure provides a driving method of a lifting device, and the lifting device includes a phase-change heat exchange module, an oil bag module, a pressurized energy storage module, and a drive energy storage module. The driving method includes: controlling the pressurized energy storage module to extract hydraulic oil in the oil bag module to decrease a volume of the oil bag module, thereby making the lifting device descend based on buoyancy; transmitting the hydraulic oil to the phase-change heat exchange module from the pressurized energy storage module during a transformation of a phase-change material from liquid-phase to solid-phase in the phase-change heat exchange module based on an external temperature drop; transmitting, based on an external pressure of the oil bag module, the hydraulic oil in the oil bag module to the pressurized energy storage module, thereby making the volume of the oil bag module decrease and the lifting device descend based on buoyancy; controlling the drive energy storage module to transmit the hydraulic oil to the oil bag module, thereby making the volume of the oil bag module increase and the lifting device rise based on buoyancy; and increasing a pressure of the phase-change heat exchange module by a transformation of the phase-change material from the solid-phase to the liquid-phase based on an external temperature rise, and transmitting the hydraulic oil in the phase-change heat exchange module to the drive energy storage module.

In an embodiment of the disclosure, the controlling the pressurized energy storage module to extract hydraulic oil in the oil bag module includes: transmitting the hydraulic oil in the oil bag module to the second energy storage unit based on the pressure difference during the transformation of the phase-change material from the liquid-phase to the solid-phase.

In an embodiment, the transmitting, based on an external pressure of the oil bag module, the hydraulic oil in the oil bag module to the pressurized energy storage module includes: transmitting the hydraulic oil in the oil bag module to the second energy storage unit based on the pressure difference during the transformation of the phase-change material from the liquid-phase to the solid-phase.

In an embodiment of the disclosure, the transmitting the hydraulic oil to the phase-change heat exchange module from the pressurized energy storage module includes: transmitting, by the drive energy storage branch, the hydraulic oil in the second energy storage unit to the phase-change heat exchange module based on a pressure difference.

In an embodiment of the disclosure, the transmitting the hydraulic oil to the phase-change heat exchange module from the pressurized energy storage module further includes: transmitting, by the drive energy storage branch, the hydraulic oil to the phase-change heat exchange module from the oil bag module based on a pressure difference.

In an embodiment of the disclosure, before the controlling the pressurized energy storage module to extract hydraulic oil in the oil bag module, the driving method further includes: detecting that a pressure of the first energy storage unit in the drive energy storage module reaches a preset maximum value.

In an embodiment of the disclosure, the driving method further includes: detecting volumes of the hydraulic oil transmitting in and out of the oil bag module, and calculating a total volume of the hydraulic oil in the oil bag module; and sending out a rising signal when the total volume of the hydraulic oil in the oil bag module reaches a preset volume.

In an embodiment of the disclosure, the driving method further includes: detecting a pressure in the oil bag module and calculating a descending distance and/or a rising distance of the lifting device.

In an embodiment of the disclosure, the driving method further includes: detecting the pressure of the second energy storage unit, and controlling the lifting device to rise when the pressure of the second energy storage unit reaches the preset value.

In an embodiment of the disclosure, the driving method further includes: controlling a transmitting speed of transmitting the hydraulic oil from the drive energy storage module to the oil bag module.

According to the driving method of the lifting device provided by the above embodiments of the disclosure, by controlling the pressurized energy storage module, a volume-change rate during a transformation of the phase-change material of the phase-change heat exchange module from liquid-phase to solid-phase is ensured and a descending force is provided for the lifting device. By controlling the drive energy storage module, a rising force is provided for the lifting device. By a control method using two energy storage structures, the reuse of the lifting device can be achieved, and the effect of underwater surveys is improved.

DESCRIPTION OF REFERENCE NUMERALS

Figure 1:
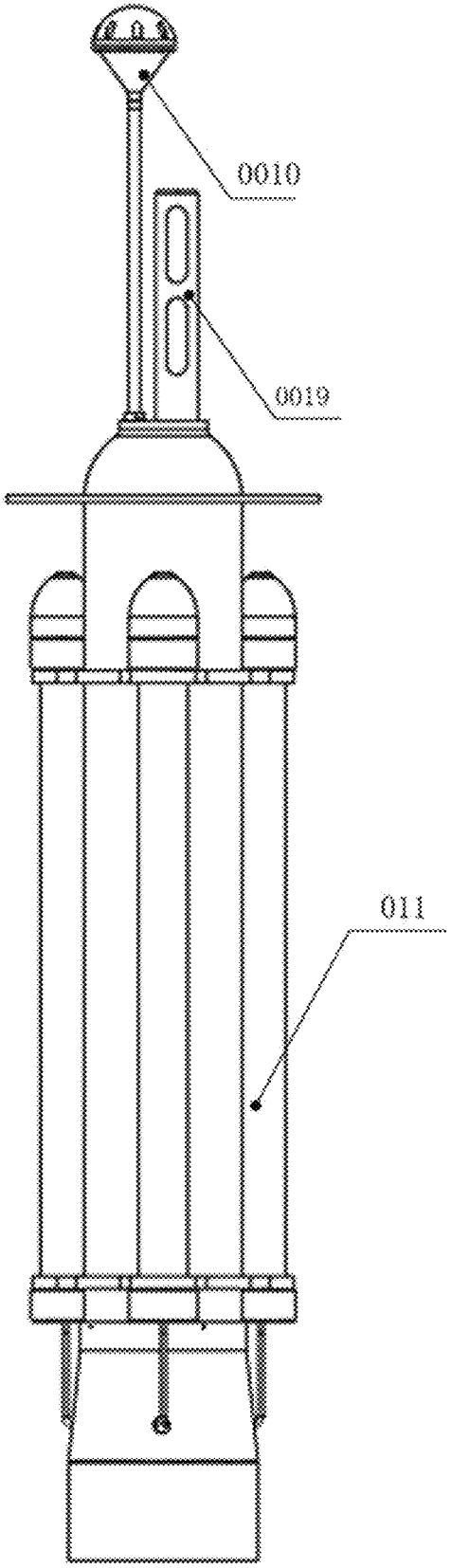
FIG. 1 illustrates a side view of a lifting device according to an embodiment of the disclosure.

001—phase-change heat exchange module; 011—phase-change heat exchange device; 111—phase-change material; 112—hydraulic oil chamber; 012—guiding cover; 013—upper fixed disc; 014—lower fixed disc; 015—oil valve; 002—housing assembly; 021—main housing; 022—top end cover; 023—bottom end cover; 024—first fixed disc; 025—second fixed disc; 026—third fixed disc; 027—fourth fixed disc; 003—oil bag module; 031—oil bag; 004—drive energy storage module; 041—first energy storage unit; 042—third sensor; 043—control valve; 044—first one-way valve; 045—pressure-reducing valve; 046—first throttle valve; 005—pressurized energy storage module; 051—second energy storage unit; 052—active energy storage branch; 521—hydraulic pump; 522—third one-way valve; 053—passive energy storage branch; 531—passive pipeline; 532—fourth sensor; 533—second throttle valve; 541—second one-way valve; 551—three-way valve; 006—first sensor; 007—flowmeter; 008—second sensor; 009—relief valve; 0010—antenna; 0011—ball valve actuator; 0012—damping disc; 0013—bottom support; 0014—battery pack; 0015—main control board; 0016—top pull stud; 0017—bottom pull stud; 0018—sealing bolt; 0019—survey device.

DETAILED DESCRIPTION OF EMBODIMENTS

In order to make the purpose, technical solutions, and advantages of the disclosure clearer, the following is a detailed explanation of the disclosure in combination with specific embodiments and attached drawings. However, the disclosure can be implemented in different embodiments and should not be limited to the embodiments provided here. On the contrary, the embodiments provided in the disclosure clearly describe the disclosure and make the scope of the disclosure clear to those skilled in the art. In the attached drawings, in order to clearly describe the disclosure, relevant sizes may be exaggerated, and the same reference numerals in the attached drawings indicate the same components.

The following describes embodiments of the disclosure with reference to the attached drawings. However, it should be understood that these descriptions are only exemplary and not intended to limit the scope of the disclosure. In the detailed description below, many specific details have been described to provide a comprehensive understanding of the embodiments of the disclosure for the clear explanation. However, it is apparent that one or more embodiments can also be implemented without these specific details. In addition, in the following explanation, the description of well-known structures and techniques has been omitted to avoid unnecessary confusion with the concepts of the disclosure.

The terms used here are only intended to describe specific embodiments and are not intended to limit the disclosure. The terms "include, "contain", etc. used here indicate the existence of the features, steps, operations, and/or components, but do not exclude the existence or addition of one or more other features, steps, operations, or components.

All terms including technical and scientific terms used here have the meanings commonly understood by those skilled in the art, unless otherwise defined. It should be noted that the terms used here should be explained as having the meanings with the terms in the specification, and should not be explained in an idealized or stereotypical manner.

In order to facilitate those skilled in the art understanding the technical solutions of the disclosure, the following technical terms are hereby explained and explained.

In the case of using an expression such as "at least one of A, B, and C, etc.", it should generally be explained according to the meaning commonly understood by those skilled in the art (for example, "a system including at least one of A, B, and C" should include but not be limited to a system including A, a system including B, a system including C, a system including A and B, a system including A and C, a system including B and C, and/or a system including A, B, and C, etc.). In the case of using an expression such as "at least one of A, B, or C, etc.", it should generally be explained according to the meaning commonly understood by those skilled in the art (for example, "a system including at least one of A, B, or C" should include but not be limited to a system including A, a system including B, a system including C, a system including A and B, a system including A and C, a system including B and C, and/or a system including A, B, and C, etc.).

Figure 2:
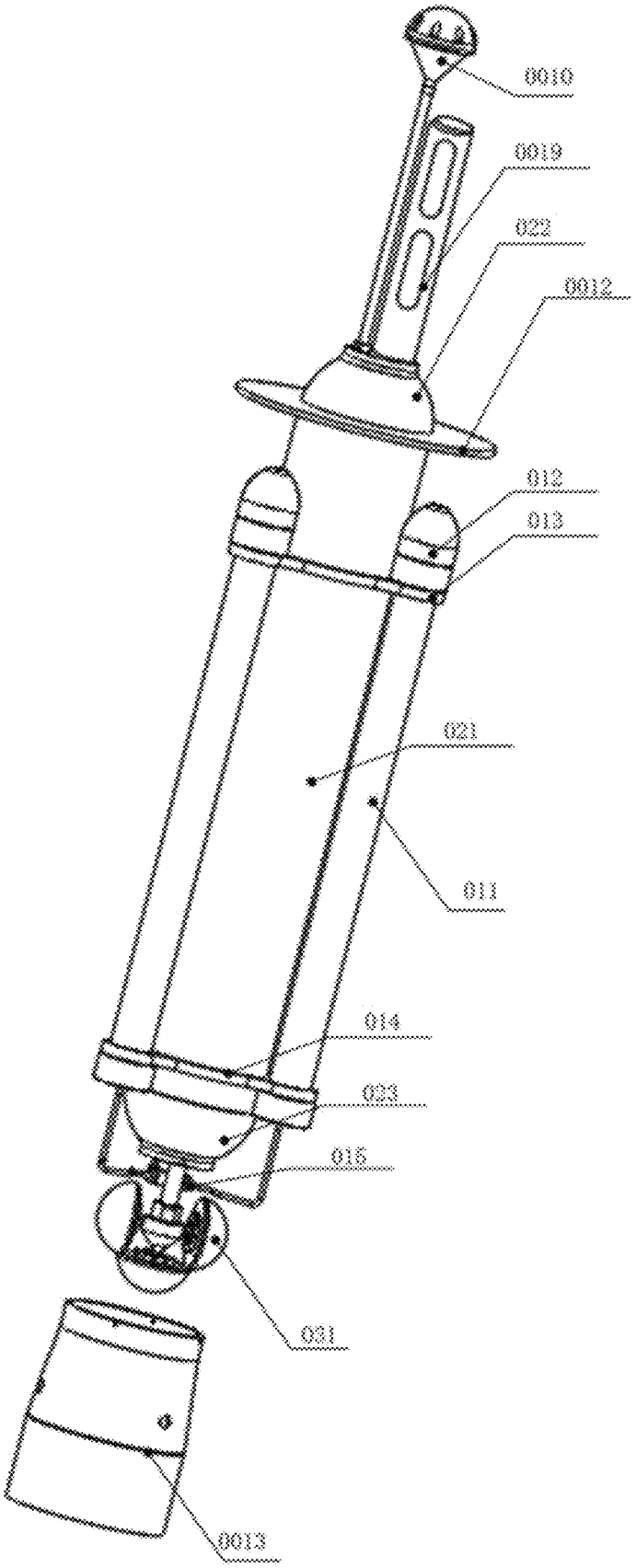
FIG. 2 illustrates a partial exploded view of the lifting device illustrated by FIG. 1.
Figure 3:
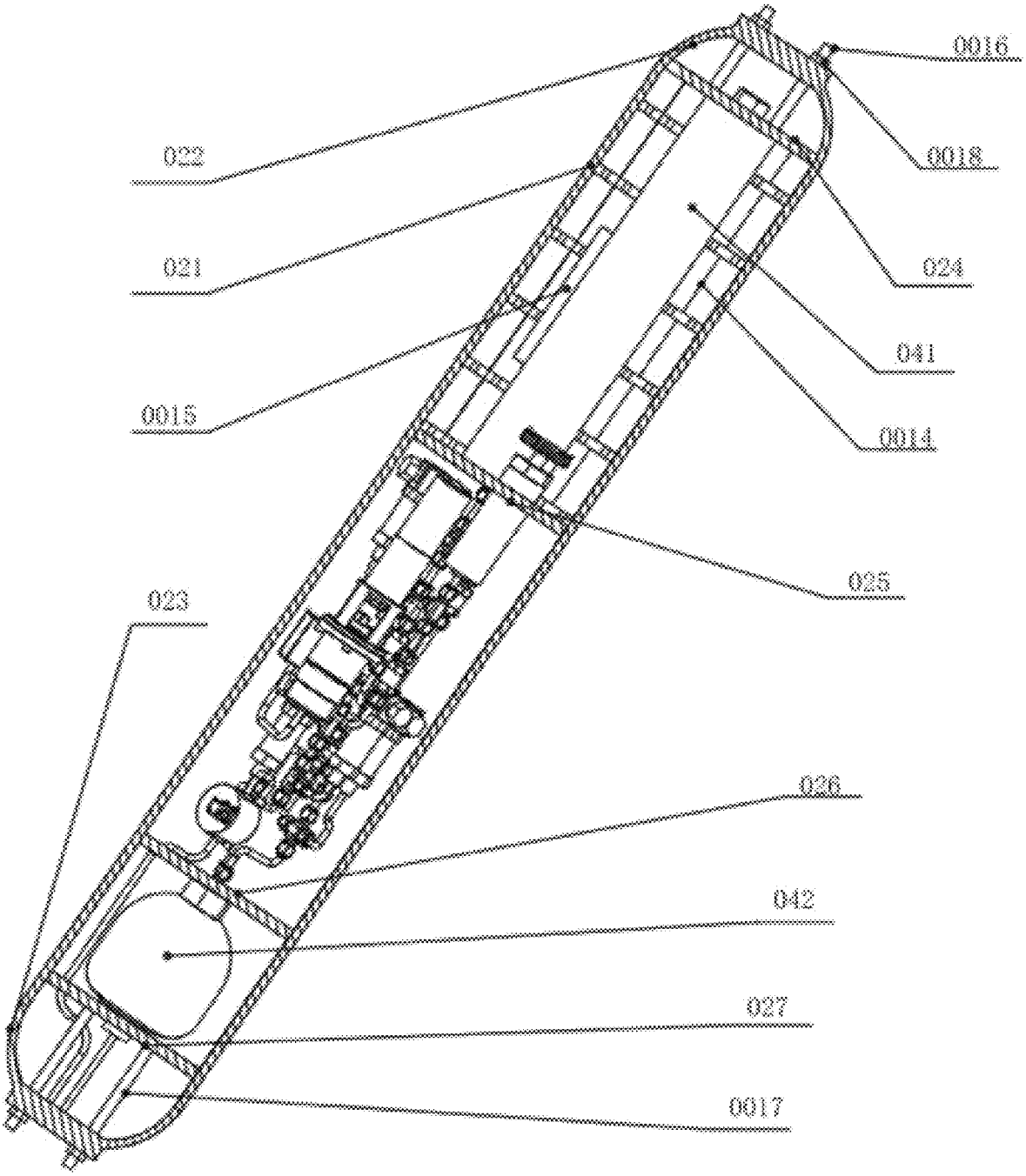
FIG. 3 illustrates a partial sectional view of the lifting device illustrated by FIG. 1.
Figure 5:
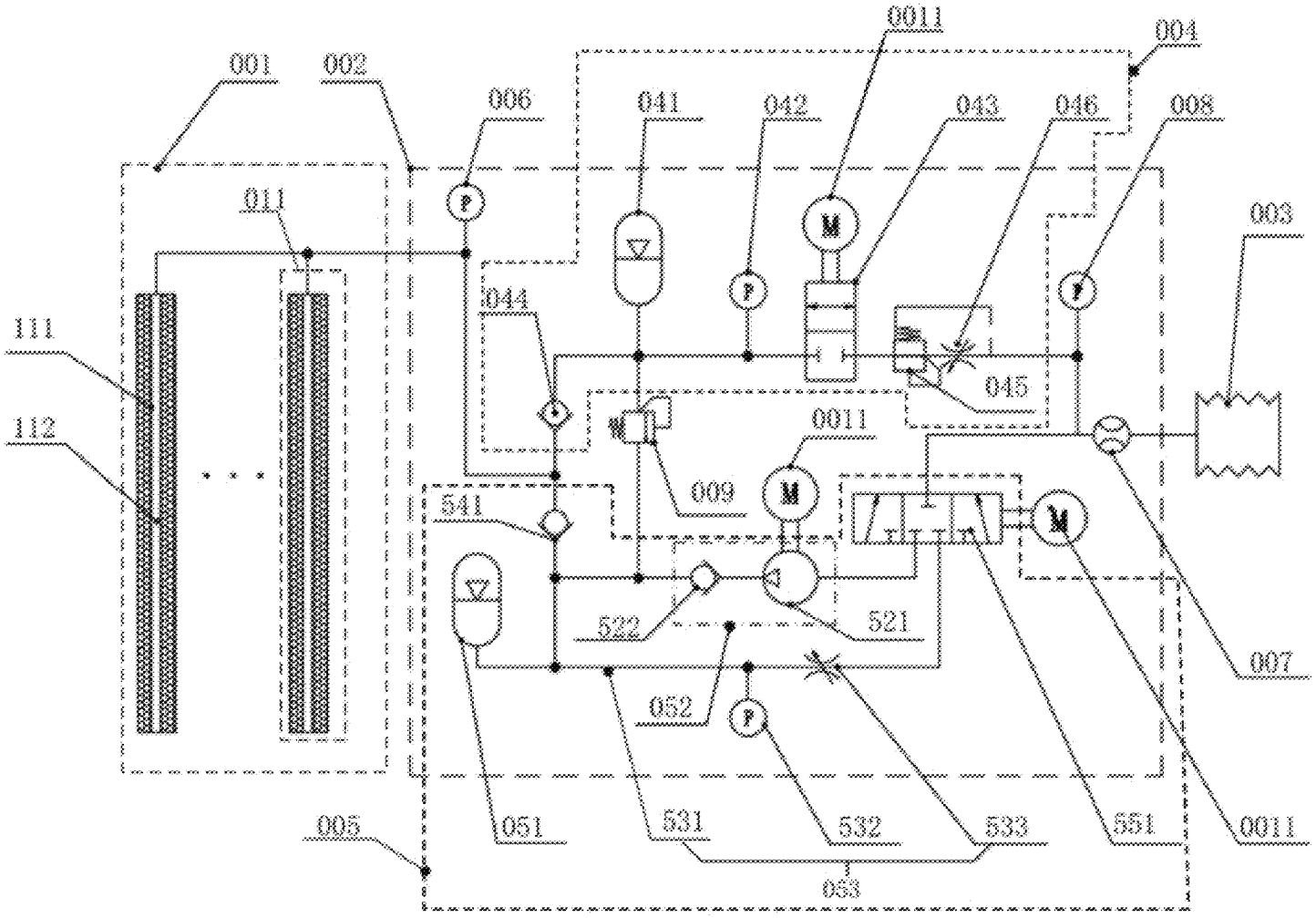
FIG. 5 illustrates a simple working principle diagram of the lifting device illustrated by FIG. 1.

FIG. 1 illustrates a side view of a lifting device according to an embodiment of the disclosure. FIG. 2 illustrates a partial exploded view of the lifting device illustrated by FIG. 1. FIG. 3 illustrates a partial sectional view of the lifting device illustrated by FIG. 1. FIG. 5 illustrates a simple working principle diagram of the lifting device illustrated by FIG. 1.

An embodiment of the disclosure provides a lifting device. As shown in FIG. 1, FIG. 3, and FIG. 5, the lifting device includes a housing assembly 002, a phase-change heat exchange module 001, an oil bag module 003, a pressurized energy storage module 005, and a drive energy storage module 004.

In some embodiments, as shown in FIG. 1 to FIG. 3, the housing assembly 002 defines an accommodation space. The housing assembly 002 can be a pressure-resistant housing. The housing assembly 002 includes a main housing 021, a top end cover 022, and a bottom end cover 023. The upper and lower ends of the main housing 021 define a sealing space with the top end cover 022 and the bottom end cover 023 by squeezing sealing rings. A damping disc 0012 is installed through bolt connection at the connection between the top end cover 022 and the main housing 021, which can prevent the lifting device from tilting and improve communication.

Furthermore, top pull studs 0016 are installed on the top end cover 022 of the housing assembly 002 through sealing bolts 0018 and bottom pull studs 0017 are installed on the bottom end cover 023 of the housing assembly 002 through sealing bolts 0018, thereby to achieve a tight connection among the main housing 021, top end cover 022, and bottom end cover 023, ensuring good sealing of the lifting device.

Furthermore, referring to FIGS. 1-3 and 5, the phase-change heat exchange module 001 is located outside the housing assembly 002, and the inside of the phase-change heat exchange module 001 is provided with a phase-change material 111. The phase-change material 111 performs phase-change with changes of external temperature, causing the pressure inside the phase-change heat exchange module 001 to increase or decrease. The oil bag module 003 is located outside the housing assembly 002 and is configured to store hydraulic oil, and a volume of the oil bag module 003 increases or decreases to rise or descend the lifting device. The pressurized energy storage module 005 and the drive energy storage module 004 are installed inside the housing assembly 002, components inside the housing assembly 002 adopts lightweight and integrated components, pipelines, and layout methods, greatly reducing weight, reducing energy consumption, and effectively improving the service life of the lifting device.

In an embodiment of the disclosure, as shown in FIG. 1 and FIG. 2, the lifting device is provided with an antenna 0010 which is arranged on the top end cover 022 of the housing assembly 002, and an oil valve 015 and the oil bag module 003 are installed below the bottom end cover 023 of the housing assembly 002 to connect the pressurized energy storage module 005 and the drive energy storage module 004. The oil bag module 003 includes multiple oil bags 031, and the hydraulic oil stored inside the oil bags 031 can be No. 10 aviation hydraulic oil, a filling volume of each oil bag 31 can be set to 800 mL The oil bag module 003 increases or decreases in volume with the change of the hydraulic oil stored inside the oil bags 031, thereby to rise or descend the lifting device.

In some embodiments, the lifting device can install a bottom support 0013 on the bottom end cover 023 to protect the oil bag module 003 and the hydraulic pipelines of the phase-change heat exchange device 011, as shown in FIGS. 1-3, and a stepped cylindrical bottom support 0013 is installed on the bottom end cover 023.

In some embodiments, as shown in FIG. 3, the accommodation space of the housing assembly 002 is sequentially divided into five small spaces by a first fixed disc 024, a second fixed disc 025, a third fixed disc 026, and the fourth fixed disc 027.

The air inlet at the upper end of the first energy storage unit 041 is fixedly installed with a hole in the middle of the first fixed disc 024, and the oil inlet at the lower end of the first energy storage unit 041 is fixedly connected to the upper side of the second fixed disc 025.

The pressurized energy storage module 005 and the drive energy storage module 004 are arranged between the second fixed disc 025 and the third fixed disc 026.

A battery pack 0014 and a main control board 0015 are fixed between the first fixed disc 024 and the second fixed disc 025 through a self-locking high-strength nylon rolling strip, the battery pack 0014 and the main control board 0015 are configured to provide power and control support for the lifting device.

The oil inlet of the second energy storage unit 051 is fixedly connected to the middle hole of the third fixed disc 026, and the air inlet of the second energy storage unit 051 is fixedly connected to the fourth fixed disc 027.

In some embodiments, as shown in FIG. 1 and FIG. 2, the above driving method is applicable to an underwater survey system, the underwater survey system includes a lifting device and a survey device 0019 installed on the lifting device. The survey device 0019 is installed at the top end cover 022 by threads and sealed by pressing the sealing ring. The survey device 0019 achieves underwater movement based on the lifting device. The working status of the survey device 0019 is controlled through the main control board 0015, and the data collected by the survey device 0019 is stored. When the lifting device drives the survey device 0019 to rise to the surface of seawater, the main control board 0015 sends the data to a control center on land through the antenna 0010. Different types of survey devices 0019, such as a hydrophone and a sound velocity profiler, can be replaced according to actual survey needs.

In an embodiment of the disclosure, as shown in FIG. 1 and FIG. 2, the phase-change heat exchange module 001 includes multiple phase-change heat exchange devices 011. Each of the phase-change heat exchange devices 011 is in a form of a slender cylinder, the phase-change heat exchange devices 011 are evenly distributed on the outer side of the housing assembly 002 and connected by high-pressure pipelines, and the joints of the high-pressure pipelines are designed as expandable interfaces which can be set according to the actual energy required by the survey device 0019, thereby to achieve the module design of the lifting device.

A top of each of the phase-change heat exchange devices 011 is provided with a guiding cover 012 which can significantly reduce the fluid resistance coefficient and energy loss during device operation. The phase-change heat exchange devices 011 are installed around the main housing 021 through the upper fixed discs 013 and the lower fixed discs 014.

Furthermore, the phase-change material 111 inside the phase-change heat exchange module 001 performs phase-change with changes of external temperature. As the external temperature increases, the volume of the phase-change material 111 increases, and the pressure inside the phase-change heat exchange module 001 increases. As the external temperature decreases, the volume of the phase-change material 111 decreases, and the pressure inside the phase-change heat exchange module 001 decreases, thereby increasing or decreasing the pressure inside the phase-change heat exchange module 001.

In some embodiments, the lifting device is further provided with a first sensor 006, a flowmeter 007, and a second sensor 008.

Specifically, the first sensor 006 is configured to detect the pressure of the phase-change heat exchange module 001. The flowmeter 007 is in communication with the pressurized energy storage module 005, the drive energy storage module 004, and the oil bag module 003, and can output pulses bidirectionally. The flowmeter 007 is configured to calculate a total oil volume (also referred to as a total volume of the hydraulic oil) inside the oil bag module 003 based on the volumes of hydraulic oil flowing in and out of the oil bag module 003. The second sensor 008 is in communication with the oil bag module 003 and is configured to detect a pressure in the oil bag module 003, thereby to calculate the descending and/or raising distance of the lifting device based on the pressure inside the oil bag module 003.

Figure 4:
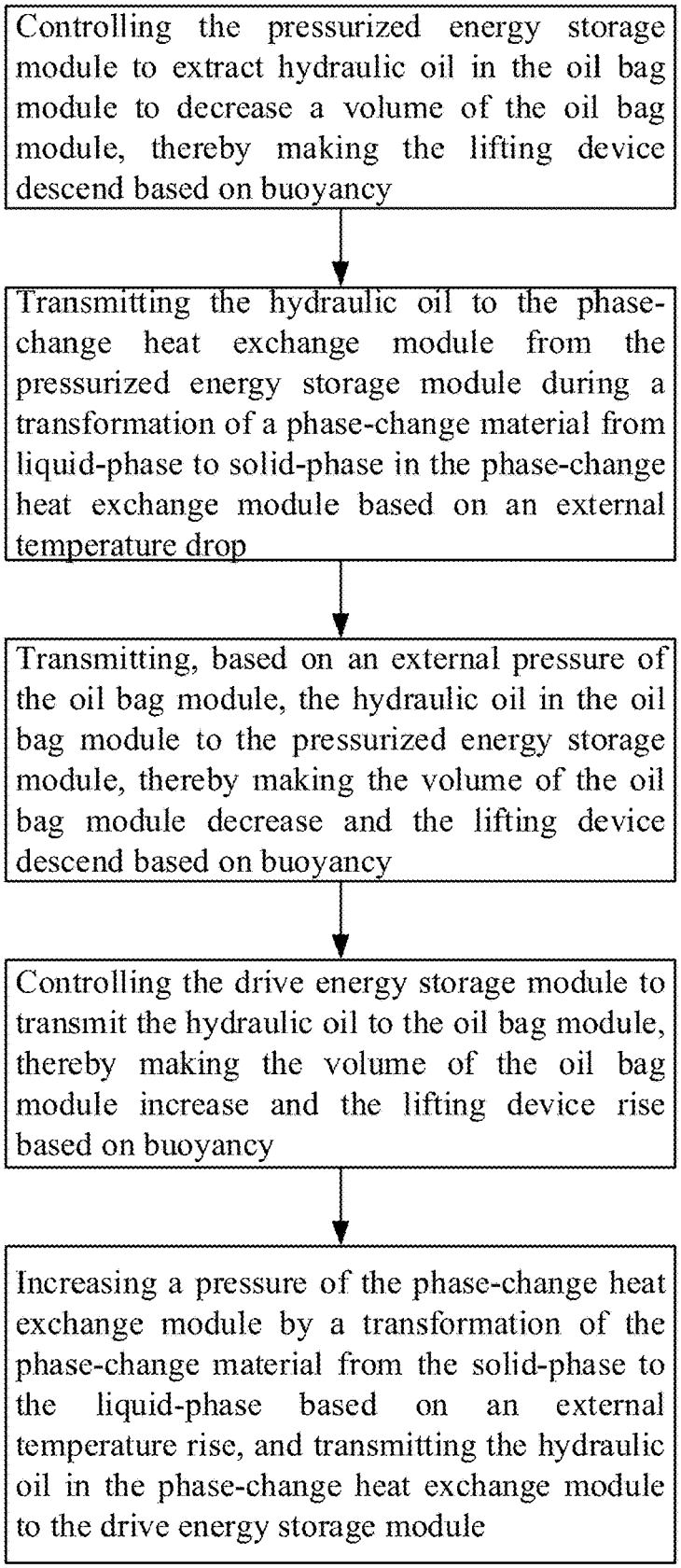
FIG. 4 illustrates a flowchart of a driving method of a lifting device according to an embodiment of the disclosure.

FIG. 4 illustrates a flowchart of a driving method of a lifting device according to an embodiment of the disclosure.

An embodiment of the disclosure provides a driving method of the lifting device, as shown in FIGS. 1,2,3 and 5. The lifting device includes a phase-change heat exchange module 001, an oil bag module 003, a pressurized energy storage module 005, and a driving energy storage module 004. As shown in FIG. 4, the driving method of the lifting device according to an embodiment of the disclosure includes:

controlling the pressurized energy storage module 005 to extract hydraulic oil in the oil bag module 003 to decrease a volume of the oil bag module 003, thereby making the lifting device descend based on buoyancy;

transmitting the hydraulic oil to the phase-change heat exchange module 001 from the pressurized energy storage module 005 during a transformation of a phase-change material 111 from liquid-phase to solid-phase in the phase-change heat exchange module 001 based on an external temperature drop;

transmitting, based on an external pressure of the oil bag module 003, the hydraulic oil in the oil bag module 003 to the pressurized energy storage module 005, thereby making the volume of the oil bag module 003 decrease and the lifting device descend based on buoyancy;

controlling the drive energy storage module 004 to transmit the hydraulic oil to the oil bag module 003, thereby making the volume of the oil bag module 003 increase and the lifting device rise based on buoyancy; and increasing a pressure of the phase-change heat exchange module 001 by a transformation of the phase-change material 111 from the solid-phase to the liquid-phase based on an external temperature rise, and transmitting the hydraulic oil in the phase-change heat exchange module 001 to the drive energy storage module.

In an embodiment of the disclosure, as shown in FIG. 1 and FIG. 2, the lifting device is further provided with an antenna 0010 to receive control signals from the outside, correspondingly, the inside of the lifting device is further provided with a main control board 0015 and a battery pack 0014 to provide power and control support for the lifting device.

Furthermore, as shown in FIG. 5, the phase-change heat exchange module 001 includes multiple phase-change heat exchange devices 011 which can be set based on the actual energy required by the survey device 0019. Each of the phase-change heat exchange device 011 includes two chambers, one of the chambers contains the phase-change material 111 and another chamber is a hydraulic oil chamber 112 configured to store hydraulic oil, and an oil resistant hose is used to isolate the two chambers to achieve a seal. The phase-change material 111 is affected by temperature and performs phase-change. For example, when the external temperature rises and the phase-change material 111 transforms from solid-phase to liquid-phase, the volume of the phase-change material 111 increases, thereby causing a pressure inside the phase-change heat exchange device 011 to increase. When the pressure inside the phase-change heat exchange device 011 increases, hydraulic oil is squeezed out of the phase-change heat exchange device 011 and flows into the drive energy storage module 004. When the external temperature drops, phase-change occurs in the phase-change material 111 under the influence of temperature. For example, during a transformation of the phase-change from liquid-phase to solid-phase, the volume of phase-change material 111 decreases, thereby causing the pressure inside phase-change heat exchanger 011 to decrease. The hydraulic oil of pressurized energy storage module 005 flows into the phase-change heat exchange device 011.

Furthermore, as shown in FIG. 5, the lifting device is further provided with a first sensor 006 configured for detecting the pressure of the phase-change heat exchange module 001, a flowmeter 007 configured for calculating the total oil volume in the oil bag module 003, and a second sensor 008 configured for detecting the pressure in the oil bag module 003. The descending distance and/or rising distance of the lifting device are calculated based on the pressure inside the oil bag module 003.

In an embodiment of the disclosure, the drive energy storage module 004 and the pressurized energy storage module 005 are connected simultaneously with the phase-change heat exchange module 001 and the oil bag module 003, respectively. The drive energy storage module 004 includes a first energy storage unit 041, a third sensor 042, a control valve 043, a first one-way valve 044, and a pressure-reducing valve 045. The pressurized energy storage module 005 is provided with a second energy storage unit 051, an active energy storage branch 052, a passive energy storage branch 053, a drive energy storage branch, and a path conversion unit.

Figure 6:
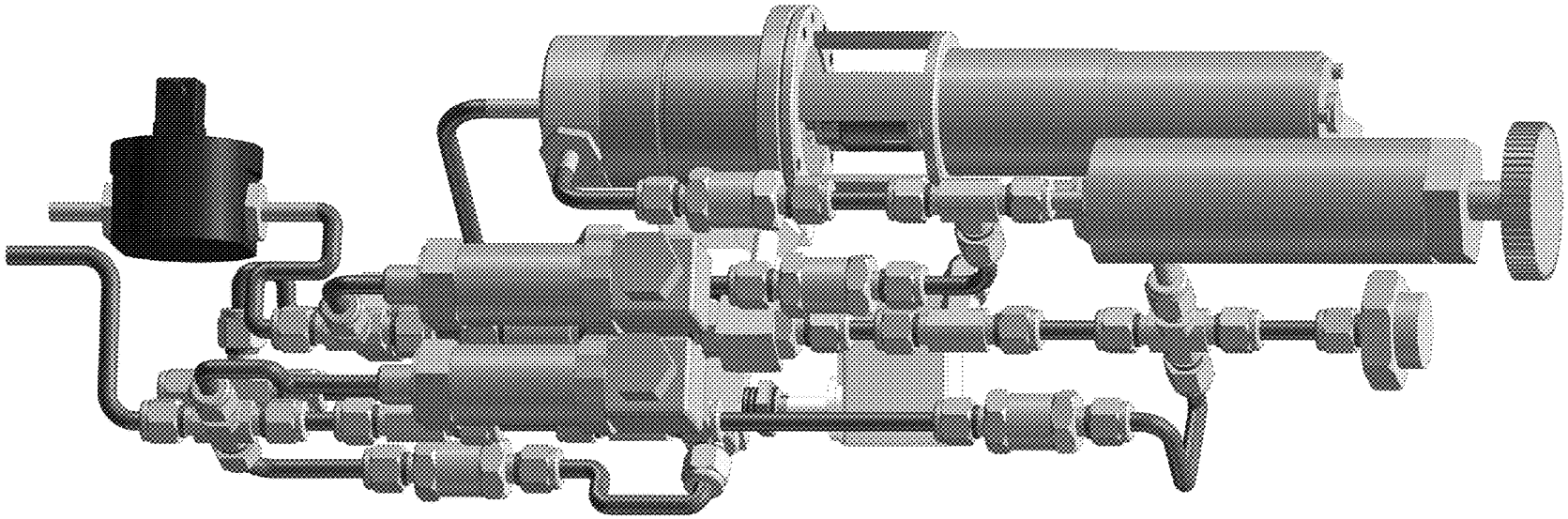
FIG. 6 illustrates a three-dimensional view of a drive energy storage module and a pressurized energy storage module of the lifting device illustrated by FIG. 1.
Figure 7:
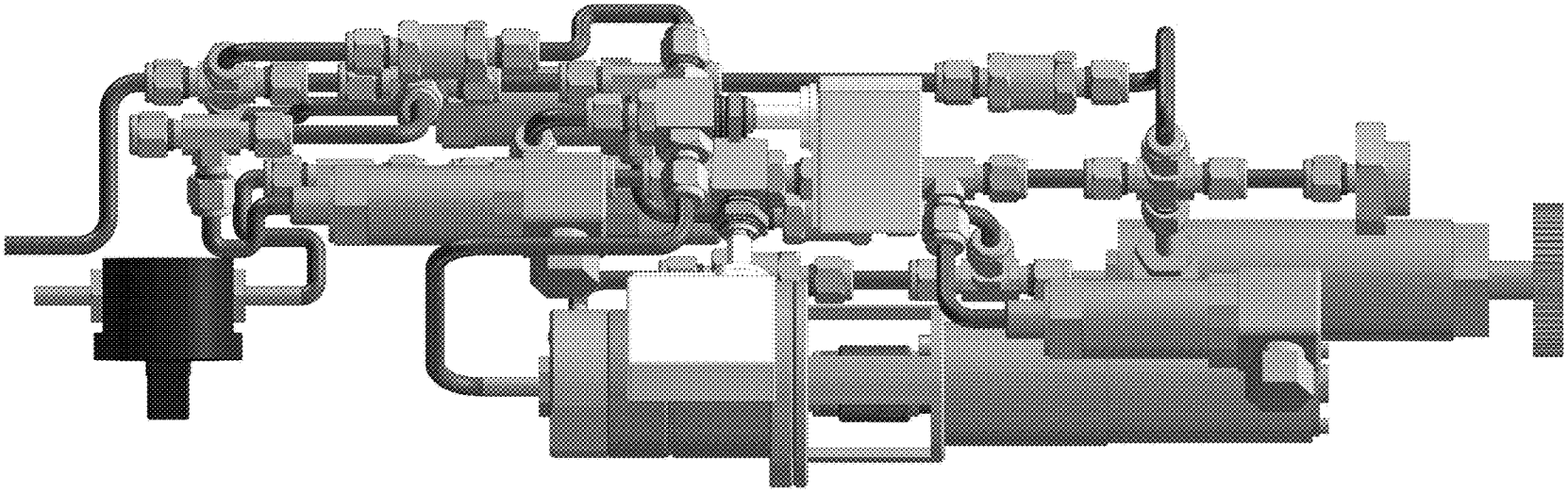
FIG. 7 illustrates another three-dimensional view of the drive energy storage module and the pressurized energy storage module of the lifting device illustrated by FIG. 1.

FIG. 6 illustrates a three-dimensional view of a drive energy storage module and a pressurized energy storage module of the lifting device illustrated by FIG. 1. FIG. 7 illustrates another three-dimensional view of the drive energy storage module and the pressurized energy storage module of the lifting device illustrated by FIG. 1.

Specifically, as shown in FIG. 5 to FIG. 7, in the drive energy storage module 004, the oil inlet of the first one-way valve 044 is connected to the phase-change heat exchange module 001, and the oil outlet of the first one-way valve 044 is sequentially connected to the first energy storage unit 041, the third sensor 042 and the control valve 043, the pressure-reducing valve 045, and the oil bag module 003. During the phase-change material 111 changes from solid-phase to liquid-phase, the hydraulic oil of phase-change material 111 flows into the first energy storage unit 041 through the first one-way valve 044. When the lifting device receives a command to rise, the control valve 043 make the first energy storage unit 041 communicate (also referred to as "connect" in the disclosure) the oil bag module 003, and hydraulic oil flows from the first energy storage unit 041 into the oil bag module 003. The volume of the oil bag module 003 increases, and the lifting device completes the rise command. The pressure-reducing valve 045 maintains a stable pressure difference between the first energy storage unit 041 and the oil bag module 003. The third sensor 042 is configured to detect the pressure inside the first energy storage unit 041. When the third sensor 042 detects that the pressure of the first energy storage unit 041 reaches a preset value, a descending signal is sent out. In an embodiment of the disclosure, a first throttle valve 046 can also be set corresponding to the pressure-reducing valve 045 to enhance the control of a flow velocity of the hydraulic oil and accurately control the output of the hydraulic oil.

Furthermore, the path conversion unit is provided with a three-way valve 551. The path conversion unit is provided with a three-way valve 551. The first energy storage unit 041 can be a high-pressure accumulator, and the pressure bearing capacity of the first energy storage unit 041 is greater than that of the oil bag module 003. The active energy storage branch 052 is provided with a hydraulic pump 521 and a third one-way valve 522. The passive energy storage branch 053 is provided with a fourth sensor 532 and a passive pipeline 531 connected between the second energy storage unit 051 and a third port of the three-way valve 551. The drive energy storage branch is provided with a second one-way valve 541.

Furthermore, in the active energy storage branch 052, the oil bag module 003 is connected to a first port of the three-way valve 551, an input port of the hydraulic pump 521 is connected to a second port of the three-way valve 551, and an output port of the hydraulic pump 521 is connected to an input port of the third one-way valve 522. During the descent of the lifting device and before the transformation of the phase-change material 111 from liquid-phase to solid-phase, the first port of the three-way valve 551 is connected to the second port of the three-way valve 551, and the hydraulic oil in the oil bag module 003 is transmitted to the second energy storage unit 051 through the hydraulic pump 521. An output port of the third one-way valve 522 is connected to the second energy storage unit 051 to prevent the hydraulic oil inside the second energy storage unit 051 from transmitting to the hydraulic pump 521.

Furthermore, in the passive energy storage branch 053, the fourth sensor 532 is disposed on the passive pipeline located between the second energy storage unit 051 and the third port of the three-way valve 551; during the descent of the lifting device and the transformation of the phase-change material 111 from the liquid-phase to the solid-phase, the first port of the three-way valve 551 is connected to the third port of the three-way valve 551, the hydraulic oil in the oil bag module 003 is transmitted to the second energy storage unit 051 based on a pressure difference; when the fourth sensor 532 detects that a pressure of the second energy storage unit 051 reaches a preset value, a rising signal is sent out.

Furthermore, a relief valve 009 is installed between the active energy storage branch 052 and the drive energy storage module 004 to protect the oil circuit.

Furthermore, the drive energy storage branch communicates the second energy storage unit 051, and during the descent of the lifting device and the transformation of the phase-change material 111 from liquid-phase to solid-phase, the hydraulic oil of the second energy storage unit 051 is transmitted to the phase-change heat exchange module 001 based on a pressure difference. The drive energy storage branch directly communicates the passive energy storage branch 053. During the transformation of the phase-change material 111 from liquid-phase to solid-phase, the hydraulic oil in the oil bag module 003 can directly flow into the phase-change heat exchange module 001 through the passive energy storage branch 053. Due to the action of the second one-way valve 541, the hydraulic oil of the second energy storage unit 051 and the hydraulic oil in the oil bag module 003 can only flow unidirectionally into the phase-change heat exchange module 001, which means that the unidirectional flowing of the hydraulic oil in the pressurized energy storage module 005 can be realized. The second energy storage unit 051 ensures that the phase-change material 111 always performs phase-change under a pressure, and a stable volume-change rate is ensured. Furthermore, a second throttle valve 533 can be installed on the passive energy storage branch 053 to enhance the control of a flow velocity of the hydraulic oil and accurately control the output of the hydraulic oil.

In an embodiment of the disclosure, referring to FIG. 6 and FIG. 7, each component is connected through a high-pressure pipeline and an integrated valve block. Referring to FIG. 5, the three-way valve 551, the hydraulic pump 521, and the control valve 043 are controlled through ball valve actuators 0011.

In some embodiments, the pressure inside the oil bag module 003 is detected by the second sensor 008, the descending distance of the lifting device is calculated for reaching a preset depth, and the third sensor 042 detects the pressure of the second energy storage unit 051. When the pressure of the second energy storage unit 051 is detected to reach a preset value, the lifting device is controlled to rise.

In some embodiments of the disclosure, as shown in FIGS. 5, 6, and 7, a driving process of performing the driving method of the lifting device includes following steps.

Step 1: The main control board 0015 controls the communication between the first port and second port of the three-way valve 551 and controls the active energy storage branch 052 in the pressurized energy storage module 005 to extract hydraulic oil from the oil bag module 003 to the second energy storage unit 051 in the pressurized energy storage module 005 through the hydraulic pump 521, thereby to decrease the volume of the oil bag module 003 and descend the lifting device based on buoyancy.

Step 2: Based on the external temperature drop, during transformation of the phase-change material 111 of the phase-change heat exchange module 001 from liquid-phase to solid-phase, the drive energy storage branch of the pressurized energy storage module 005 transmits hydraulic oil in the second energy storage unit 051 to the phase-change heat exchange module 001 based on a pressure difference. And the main control board 0015 controls the communication between first port and third port of the three-way valve 551, and the oil bag module 003 directly transmits hydraulic oil to the phase-change heat exchange module 001 through the drive energy storage branch based on a pressure difference. That is to say, both the oil bag module 003 and the second energy storage unit 051 provide hydraulic oil to the phase-change heat exchange module 001. In the same way, during the transformation of phase-change material 111 from liquid-phase to solid-phase, the hydraulic oil in the oil bag module 003 based on the external pressure of the oil bag module 003 flows into the second energy storage unit 051 of the pressurized energy storage module 005, the volume of the oil bag module 003 decreases, and the lifting device decreases based on buoyancy. The second sensor 008 is configured to detect the pressure inside the oil bag module 003 and calculate the descending distance of the lifting device.

Step 3: The second sensor 008 detects the volume of hydraulic oil flowing in and out of the oil bag module 003, and a total oil volume inside the oil bag module 003 is calculated. When the total oil volume inside the oil bag module 003 reaches the preset oil volume for rising, the main control board 0015 stop the communication between the first port and second port of the three-way valve 551, and the lifting device continues to descend. When the second sensor 008 detects the pressure in the oil bag module 003, a descending distance of the lifting device is calculated for reaching a preset depth, and the third sensor 042 detects that the pressure in the second energy storage unit 051 reaches a preset value, a rising signal is sent out.

Step 4: The main control board 0015 controls the control valve 043 to make the first energy storage unit 041 communicate the oil bag module 003, the first energy storage unit 041 of the drive energy storage module 004 transmit hydraulic oil to the oil bag module 003 to increase the volume of the oil bag module 003, and thus the lifting device rises based on buoyancy. The flow velocity of the hydraulic oil is controlled by a relief valve 009. The second sensor 008 detects the pressure inside the oil bag module 003, and a rising distance of the lifting device is calculated.

Step 5: When the pressure of phase-change heat exchange module 001 increases during the transformation of phase-change material 111 changes from solid-phase to liquid-phase based on a rise of external temperature, hydraulic oil in phase-change heat exchange module 001 flows into the first energy storage unit 041 of the pressurized energy storage module 005 to prepare for a next lifting.

In some embodiments, a process before controlling the pressurized energy storage module 005 to extract hydraulic oil in the oil bag module 003 includes: detecting that a pressure of the first energy storage unit 041 in the drive energy storage module 004 has reached a preset maximum value. Specifically, during a lifting process of the lifting device, when the lifting device returns to the water surface, during a transformation of the phase-change material 111 from solid-phase to liquid-phase based on external temperature rise, the hydraulic oil in the phase-change heat exchange module 001 flows into the drive energy storage module 004, the pressure of the first energy storage unit 041 increases. When the pressure of the first energy storage unit 041 reaches the preset maximum value, the next lifting movement of the lifting device can be performed.

The phase-change heat exchange module 001 is provided with three sets of phase-change heat exchange devices 011, each of the phase-change heat exchange devices 011 can store 1 L of phase-change material 111. In an embodiment, the phase-change material 111 can be n-hexadecane with a phase-change temperature of 18.2° C. and a volume-change rate more than 15% under pressure. The second energy storage unit 051 can be a lightweight diaphragm-type low-pressure accumulator with an effective volume of 0.75 L, a pre-charging pressure of 3 MPa, and a maximum pressure of 5 MPa. The first energy storage unit 041 can be a high-pressure accumulator with an effective volume of 1 L, a pre-charging pressure of 18 MPa, and a maximum pressure of 30 MPa. The hydraulic oil stored inside the oil bag 031 is 800 mL.

Figure 8:
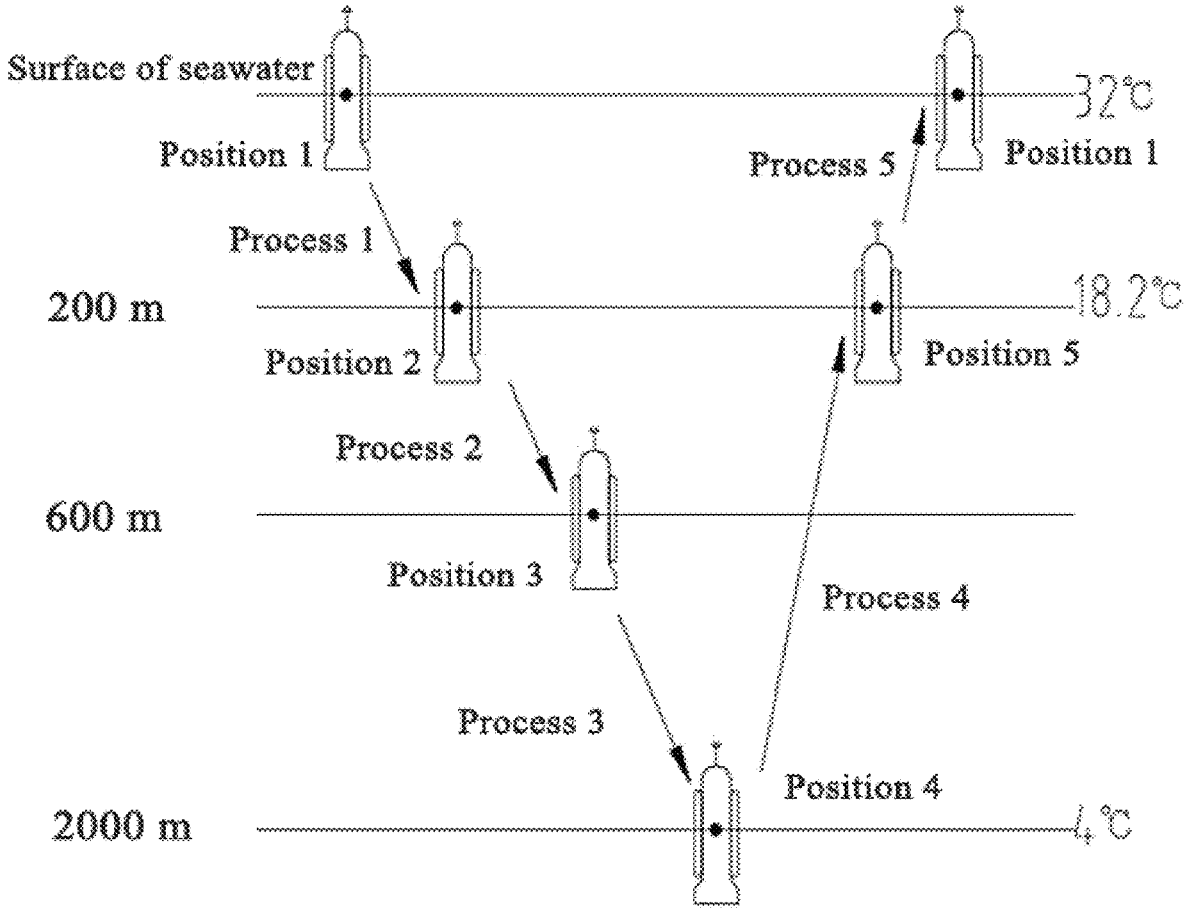
FIG. 8 illustrates a schematic diagram of a lifting process of a lifting device performed by a driving method according to an embodiment of the disclosure.

FIG. 8 illustrates a schematic diagram of a lifting process of a lifting device performed by a driving method according to an embodiment of the disclosure.

Referring to FIG. 8, during the execution of the driving method for the lifting device, the lifting process of the lifting device is as follows:

Position 1: The lifting device is located on the surface of seawater, i.e. position 1. The surface temperature of seawater is greater than the phase-change temperature of the phase-change material 111 which is liquid.

Process 1: The main control board 0015 controls the communication between the first port and second port of the three-way valve 551 and controls the active energy storage branch 052 in the pressurized energy storage module 005 to extract hydraulic oil from the oil bag module 003 to the second energy storage unit 051 in the pressurized energy storage module 005 through the hydraulic pump 521, thereby to decrease the volume of the oil bag module 003. The lifting device descends based on the reduction of buoyancy, and the second sensor 008 detects the oil volume of the oil bag module 003 in real-time. When the oil output of the oil bag module 003 reaches a preset value of the active oil-return, the three-way valve 551 is controlled to immediately stop communication between the first port and second port of the three-way valve 551, and the lifting device continues to descend until it is about 200 meters underwater, i.e. position 2.

Position 2: The lifting device descends to a depth about 200 meters, that is the lifting device is located at position 2. At this point, the seawater temperature has dropped to 18° C. which is the phase-change temperature of phase-change material 111. Therefore, the phase-change material 111 begins to solidify.

Process 2: The lifting device continues to descend to a depth about 600 meters, i.e. position 3. During this process, based on the external temperature drop, the phase-change material 111 gradually solidifies, and the pressure inside the phase-change heat exchange module 001 decreases. The second energy storage unit 051 provides hydraulic oil to the phase-change heat exchange module 001. The second sensor 008 detects that the pressure inside the oil bag module 003 reaches a preset pressure for starting passive oil-return, and the first port and third port of the three-way valve 551 is controlled to be communicated.

Position 3: The lifting device descends to a depth about 600 meters, i.e. position 3. At this point, the external pressure of the lifting device is about 6 MPa which is greater than the pressure inside the oil bag module 003 and greater than the pressure of the second energy storage unit 051. The second sensor 008 detects that the pressure inside the oil bag module 003 has reached a preset pressure for starting passive oil-return.

Process 3: The main control board 0015 controls the communication between the first port and third port of the three-way valve 551, and the external pressure presses the hydraulic oil of the oil bag module003 to flow into the second energy storage unit 051. The volume of the oil bag module 003 continues to decrease, and the lifting device descends based on buoyancy. At this process, when the second sensor 008 detects that the oil output of the oil bag module 003 has reached a preset pressure for ending the passive return oil, the main control board 0015 immediately stop the communication between the first port and third port of the three-way valve 551, and the lifting device continues to descend to a depth about 2000 meters, i.e. position 4.

Position 4: The lifting device descends to a depth about 2000 meters, i.e. position 4. At this point, the volume of oil bag 031 has reached the minimum value. The seawater temperature is about 4° C., and the fourth sensor 532 detects that the pressure of the second energy storage unit 051 has reached a preset pressure for descending. The phase-change material 111 in the phase-change heat exchange module 001 has completely solidified. The second sensor 008 detects that the external pressure has reached about 20 MPa.

Process 4: The fourth sensor 532 detects that the pressure of the second energy storage unit 051 has reached the preset pressure for descending, the phase-change material 111 in the phase-change heat exchange module 001 has completely solidified, and a control signal for rising. The main control board 0015 controls the control valve 043 to make the first energy storage unit 041 communicate the oil bag module 003, the first energy storage unit 041 of the drive energy storage module 004 transmits hydraulic oil to the oil bag module 003 to increase the volume of the oil bag module 003. The lifting device rises to about 200 meters away from the surface of seawater based on buoyancy, i.e. position 5.

Position 5: The lifting device is located at a depth of 200 meters underwater, i.e. position 5. The external temperature changes to 18.2° C., and the phase-change material 111 in phase-change heat exchange module 001 begins to perform phase-change.

Process 5: The lifting device continues to rise and moves upwards from 200 meters underwater to the surface of the seawater, that is the lifting device moves from position 5 to position 1. The temperature of seawater continues to rise, and the phase-change material 111 gradually melts and the volume of the phase-change material 111 increases. Hydraulic oil flows into the first energy storage unit 041 through the first one-way valve 044 from the phase-change heat exchange device 011, and the first energy storage unit 041 continuously stores energy to prepare for a next lifting movement.

In an embodiment of the disclosure, the output amount of hydraulic oil flowing from the oil bag module 003 to the second energy storage unit 051 and the phase-change heat exchange module 001 through the active energy storage branch 052 and the passive energy storage branch 053 is equal to the input amount of hydraulic oil flowing from the phase-change heat exchange module 001 to the oil bag module 003 through the driving energy storage module 004, thereby to maintain a balanced circulation of hydraulic oil inside the lifting device and achieve the reuse of the lifting device.

It should be noted that the directional terms mentioned in the embodiments, such as "up", "down", "front", "back", "left", "right", etc., are only referring to the direction of the attached drawings and are not intended to limit the scope of protection of the disclosure. In the attached drawings, the same elements are represented by the same or similar marks. When confusion may occur regarding the understanding of the disclosure, conventional structures or constructions will be omitted, and the shapes and sizes of each component in the attached drawings do not indicate the true size and proportion, but only illustrate the content of the embodiments of the disclosure.

Unless otherwise specified, the numerical parameters in this specification and the claims are approximate and can be changed based on the required characteristics obtained through the content of the disclosure. Specifically, all numbers used in the specification and claims to indicate the composition content, reaction conditions, etc. should be understood as being modified by the term "about" in all cases. In general, its expression refers to a specific amount has a variation of ±10% in some embodiments, a variation of ±5% in some embodiments, a variation of ±1% in some embodiments, and a variation of ±0.5% in some embodiments.

The use of ordinal numbers such as "first", "second", "third", etc. in the specification and claims to describe the corresponding components does not mean that the components have any ordinal numbers, nor does it represent the order of a certain component with another component, or the order of manufacturing methods. The use of these ordinal numbers is only used to make a clear distinction between a component with a certain name and another component with the same name.

In addition, unless specifically described or steps are required to perform in sequence, the order of the above steps is not limited to the order above and can be changed or rearranged according to the required design. The above embodiments can be mixed and used with each other or with other embodiments based on design and considerations of reliability, that is, the technical features in different embodiments can be freely combined to form more embodiments.

The specific embodiments mentioned above provide a further detailed explanation of the purpose, technical solution, and beneficial effects of the disclosure. It should be understood that the above are only specific embodiments of the disclosure and are not intended to limit it. Any modifications, equivalent replacements, improvements, etc. made within the spirit and principles of the disclosure should be included in the scope of protection of the disclosure.

What is claimed is:

1. A driving method, implemented to a lifting device of an underwater survey system, wherein the lifting device comprises a phase-change heat exchange module, an oil bag module, a pressurized energy storage module, and a drive energy storage module; and the driving method comprises:

controlling the pressurized energy storage module to extract hydraulic oil in the oil bag module to decrease a volume of the oil bag module, thereby making the lifting device descend based on buoyancy, including: controlling an active energy storage branch of the pressurized energy storage module to extract the hydraulic oil in the oil bag module through a hydraulic pump to a second energy storage unit of the pressurized energy storage module;

transmitting the hydraulic oil to the phase-change heat exchange module from the pressurized energy storage module during a transformation of a phase-change material from liquid-phase to solid-phase in the phase-change heat exchange module based on an external temperature drop;

transmitting, based on an external pressure of the oil bag module, the hydraulic oil in the oil bag module to the pressurized energy storage module, thereby making the volume of the oil bag module decrease and the lifting device descend based on buoyancy;

controlling the drive energy storage module to transmit the hydraulic oil to the oil bag module, thereby making the volume of the oil bag module increase and the lifting device rise based on buoyancy; and increasing a pressure of the phase-change heat exchange module by a transformation of the phase-change material from the solid-phase to the liquid-phase based on an external temperature rise, and transmitting the hydraulic oil in the phase-change heat exchange module to the drive energy storage module;

wherein the drive energy storage module comprises a first energy storage unit, a third sensor, a control valve, a first one-way valve, and a pressure-reducing valve; the pressurized energy storage module comprises the second energy storage unit, the active energy storage branch, a passive energy storage branch, a drive energy storage branch, and a path conversion unit; the path conversion unit comprises a three-way valve; the active energy storage branch comprises a hydraulic pump and a third one-way valve; the passive energy storage branch comprises a fourth sensor and a passive pipeline connected between the second energy storage unit and a third port of the three-way valve;

wherein in the active energy storage branch, the oil bag module is connected to a first port of the three-way valve, an input port of the hydraulic pump is connected to a second port of the three-way valve, and an output port of the hydraulic pump is connected to an input port of the third one-way valve; during the descent of the lifting device and before the transformation of the phase-change material from the liquid-phase to the solid-phase, the first port of the three-way valve is connected to the second port of the three-way valve, and the hydraulic oil in the oil bag module is transmitted to the second energy storage unit through the hydraulic pump; an output port of the third one-way valve is connected to the second energy storage unit to prevent the hydraulic oil in the second energy storage unit from transmitting to the hydraulic pump;

wherein in the passive energy storage branch, the fourth sensor is disposed on the passive pipeline and located between the second energy storage unit and the third port of the three-way valve; during the descent of the lifting device and the transformation of the phase-change material from the liquid-phase to the solid-phase, the first port of the three-way valve is connected to the third port of the three-way valve, the hydraulic oil in the oil bag module is transmitted to the second energy storage unit based on a pressure difference; when the fourth sensor detects that a pressure of the second energy storage unit reaches a preset value, a rising signal is sent out; and wherein the second energy storage unit is an accumulator, and a pre-charging pressure of the accumulator is 3 megapascals (MPa), the accumulator is configured to enable the phase-change material to perform phase-change under a pressure.

2. The driving method according to claim 1, wherein the transmitting, based on an external pressure of the oil bag module, the hydraulic oil in the oil bag module to the pressurized energy storage module comprises: transmitting the hydraulic oil in the oil bag module to the second energy storage unit based on the pressure difference during the transformation of the phase-change material from the liquid-phase to the solid-phase.

3. The driving method according to claim 1, wherein the transmitting the hydraulic oil to the phase-change heat exchange module from the pressurized energy storage module comprises: transmitting, by the drive energy storage branch, the hydraulic oil in the second energy storage unit to the phase-change heat exchange module based on a pressure difference.

4. The driving method according to claim 1, wherein the transmitting the hydraulic oil to the phase-change heat exchange module from the pressurized energy storage module further comprises: transmitting, by the drive energy storage branch, the hydraulic oil to the phase-change heat exchange module from the oil bag module based on a pressure difference.

5. The driving method according to claim 1, wherein before the controlling the pressurized energy storage module to extract hydraulic oil in the oil bag module, the driving method further comprises: detecting that a pressure of the first energy storage unit in the drive energy storage module reaches a preset maximum value.

6. The driving method according to claim 1, wherein the driving method further comprises: detecting volumes of the hydraulic oil transmitting in and out of the oil bag module, and calculating a total volume of the hydraulic oil in the oil bag module; and sending out a rising signal when the total volume of the hydraulic oil in the oil bag module reaches a preset volume.

7. The driving method according to claim 1, wherein the driving method further comprises: detecting a pressure in the oil bag module and calculating a descending distance and/or a rising distance of the lifting device.

8. The driving method according to claim 1, wherein the driving method further comprises: detecting the pressure of the second energy storage unit, and controlling the lifting device to rise when the pressure of the second energy storage unit reaches the preset value.

9. The driving method according to claim 1, wherein the driving method further comprises: controlling a transmitting speed of transmitting the hydraulic oil from the drive energy storage module to the oil bag module.

* * * * *